US011802723B2

(12) United States Patent
Kawashima et al.

(10) Patent No.: US 11,802,723 B2
(45) Date of Patent: Oct. 31, 2023

(54) AIR-CONDITIONING APPARATUS

(71) Applicant: Mitsubishi Electric Corporation, Tokyo (JP)

(72) Inventors: Atsushi Kawashima, Tokyo (JP); Yasuhide Hayamaru, Tokyo (JP); Masakazu Sato, Tokyo (JP); Yusuke Adachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 81 days.

(21) Appl. No.: 17/616,378

(22) PCT Filed: Aug. 23, 2019

(86) PCT No.: PCT/JP2019/033161
§ 371 (c)(1),
(2) Date: Dec. 3, 2021

(87) PCT Pub. No.: WO2021/038660
PCT Pub. Date: Mar. 4, 2021

(65) Prior Publication Data

US 2022/0260292 A1 Aug. 18, 2022

(51) Int. Cl.
*F25B 47/02* (2006.01)
*F25B 49/02* (2006.01)
(Continued)

(52) U.S. Cl.
CPC ..... *F25B 47/02* (2013.01); *F25B 49/022* (2013.01); *F25D 21/002* (2013.01); *F25D 21/12* (2013.01)

(58) Field of Classification Search
CPC ..... F25B 47/02; F25B 49/022; F25D 21/002; F25D 21/12
(Continued)

(56) References Cited

U.S. PATENT DOCUMENTS

2015/0292756 A1* 10/2015 Takenaka ..... F24F 5/001 62/160
2021/0080161 A1 3/2021 Tashiro et al.

FOREIGN PATENT DOCUMENTS

DE 102012217879 A1 4/2014
JP 2008-064381 A 3/2008
(Continued)

OTHER PUBLICATIONS

Morimoto, Air Conditioner, 2009, Full Document (Year: 2009).*
(Continued)

*Primary Examiner* — Nael N Babaa
(74) *Attorney, Agent, or Firm* — POSZ LAW GROUP, PLC

(57) ABSTRACT

In an air-conditioning apparatus, a first flow passage selection device and a second flow passage selection device each are a constant-energized-type three-way valve in which a position of a main valve can be fixed in a de-energized state. When the refrigerant circuit is switched to the cooling circuit by a flow switching device, when at least one of the first flow passage selection device and the second flow passage selection device is in a de-energized state, the first flow passage selection device or the second flow passage selection device in the de-energized state is configured to output refrigerant discharged from the compressor and input therein via the flow switching device and the bypass pipe to a corresponding one of an upper-side outdoor heat exchanger and a lower-side outdoor heat exchanger.

6 Claims, 8 Drawing Sheets

(51) Int. Cl.
*F25D 21/00* (2006.01)
*F25D 21/12* (2006.01)

(58) Field of Classification Search
USPC ..... 62/151
See application file for complete search history.

(56) References Cited

FOREIGN PATENT DOCUMENTS

| | | | |
|---|---|---|---|
| JP | 5213817 | B2 * | 6/2013 |
| JP | 5213817 | B2 | 6/2013 |
| JP | 2017-057977 | A | 3/2017 |
| JP | 2017-125556 | A | 7/2017 |
| WO | 2019/146139 | A1 | 8/2019 |

OTHER PUBLICATIONS

International Search Report dated Oct. 1, 2019, issued in corresponding International Application No. PCT/JP2019/033161 (and English Machine Translation).
Office Action dated Nov. 16, 2022 issued in corresponding SE Patent Application No. 2250111-8.

* cited by examiner

AIR-CONDITIONING APPARATUS

CROSS REFERENCE TO RELATED APPLICATION

This application is a U.S. National Stage Application of International Application No. PCT/JP2019/033161, filed on Aug. 23, 2019, the contents of which are incorporated herein by reference.

TECHNICAL FIELD

The present disclosure relates to an air-conditioning apparatus that performs defrosting of an outdoor heat exchanger and an indoor heating operation at the same time.

BACKGROUND ART

During a heating operation in a winter season, frost is formed on an outdoor heat exchanger functioning as an evaporator under a low temperature and high humidity condition. When frost is formed on the outdoor heat exchanger, a ventilation resistance is increased. Consequently, the amount of heat exchanged in the outdoor heat exchanger is reduced, and thus heating capacity is lowered. To avoid this, a reverse operation is performed in which the frost formed on the outdoor heat exchanger is melted by switching circuits from a heating operation circuit to a cooling operation circuit so that the outdoor heat exchanger functions as a condenser. During the reverse operation, the heating operation is temporarily stopped and heating capacity becomes zero. As a result, the indoor temperature is lowered and thus comfortableness is reduced.

There is an air-conditioning apparatus designed to suppress deterioration of comfortableness in a room caused by a reverse operation. This air-conditioning apparatus performs removing of frost on an outdoor heat exchanger, or defrosting, and an indoor heating operation at the same time (see Patent Literature 1, for example). In Patent Literature 1, a refrigerant circuit is provided in which a compressor, a four-way valve, an indoor heat exchanger, a pressure reducing device, and an outdoor heat exchanger are connected by a refrigerant pipe and a bypass circuit is provided that allows hot gas to flow from a discharge side of the compressor to the outdoor heat exchanger. In the outdoor heat exchanger, its refrigerant circuit is divided into an upper section and a lower section for forming a lower-side outdoor heat exchanger and an upper-side outdoor heat exchanger.

The controller opens and closes main circuit opening/closing mechanisms and bypass opening/closing valves to perform a heating defrost operation, in which defrosting of the upper-side outdoor heat exchanger is performed while a heating operation is performed using the lower-side outdoor heat exchanger and then defrosting of the lower-side outdoor heat exchanger is performed while a heating operation is performed using the upper-side outdoor heat exchanger. As a result, a temperature drop in the room is prevented while lowering of a heating operation capacity of the indoor unit is prevented.

In addition, as a circuit for performing defrosting of an outdoor heat exchanger and an indoor heating operation at the same time, a circuit configuration is known in which two three-way valves as flow switching devices, a second expansion device, and a check valve are provided in addition to an ordinary refrigerant circuit.

CITATION LIST

Patent Literature

Patent Literature 1: Japanese Unexamined Patent Application Publication No. 2008-64381

SUMMARY OF INVENTION

Technical Problem

In a circuit having such a configuration, when a heating operation is performed under a condition where a main valve of one of the three-way valves fails on a cooling operation side, refrigerant having been discharged from the compressor and having passed through the indoor unit and then the outdoor unit reaches a dead end at the three-way valve and thus dogs the circuit. Consequently, the operation becomes a closed circuit operation. Hereinafter, such a closed circuit will be referred to as a "heating closed circuit".

Furthermore, when a cooling operation is performed under a condition where a main valve of one of the three-way valves fails on a heating operation side, refrigerant having been discharged from the compressor reaches a dead end at the three-way valve and thus clogs the circuit. Consequently, the operation becomes a closed circuit operation. Hereinafter, such a closed circuit will be referred to as a "cooling closed circuit". In this case, a discharge pressure may be abnormally increased, causing refrigerant pipe to burst and refrigerant leakage.

The present disclosure has been made to overcome the above-mentioned problems; and has an object to provide an air-conditioning apparatus capable of preventing operation from being performed in a closed circuit condition even when a first flow passage selection device or a second flow passage selection device fails.

Solution to Problem

According to an air-conditioning apparatus according to an embodiment of the present disclosure; the air-conditioning apparatus includes a refrigerant circuit through which refrigerant circulates and in which a compressor configured to compress and discharge refrigerant, a flow switching device connected to a refrigerant pipe of the compressor, an indoor heat exchanger connected by a pipe via the flow switching device and configured to exchange heat between refrigerant discharged from the compressor and indoor air, an expansion device configured to decompress refrigerant condensed in the indoor heat exchanger, an outdoor heat exchanger including an upper-side outdoor heat exchanger and a lower-side outdoor heat exchanger each having an independent flow passage, the outdoor heat exchanger being configured to exchange heat between refrigerant having passed through the expansion device and outdoor air, a first flow passage selection device connected to a pipe of the upper-side outdoor heat exchanger of the outdoor heat exchanger and a pipe on a suction side of the compressor, a second flow passage selection device connected to a pipe of the lower-side outdoor heat exchanger of the outdoor heat exchanger and a pipe on a suction side of the compressor, and a bypass pipe connecting between a discharge side of the compressor and the first flow passage selection device and connecting between the discharge side of the compressor and the second flow passage selection device are provided. The air-conditioning apparatus further includes a controller configured to control the flow switching device configured to switch the refrigerant circuit between a cooling circuit in which the first flow passage selection device and the second flow passage selection device cause refrigerant discharged from the compressor and input therein via the bypass pipe to flow into the upper-side outdoor heat exchanger and the lower-side outdoor heat exchanger, respectively, and a heating circuit in which the first flow passage selection device and the second flow passage selection device cause refrigerant input therein from the upper-side outdoor heat exchanger and the lower-side outdoor heat exchanger to flow into the pipes on the suction side of the compressor. The first flow passage selection device and the second flow passage selection device each are a constant-energized-type three-way valve in which a position of a main valve can be fixed in a de-energized state. In a case where the refrigerant circuit is switched to the cooling circuit by the flow switching device, when at least one of the first flow passage selection device and the second flow passage selection device is in a de-energized state, the first flow passage selection device or the second flow passage selection device in the de-energized state is configured to output refrigerant discharged from the compressor and input therein via the flow switching device and the bypass pipe to a corresponding one of the upper-side outdoor heat exchanger and the lower-side outdoor heat exchanger.

Advantageous Effects of Invention

According to an embodiment of the present disclosure, the air-conditioning apparatus can be provided capable of preventing operation from being performed in a closed circuit condition even when the first flow passage selection device or the second flow passage selection device fails.

DESCRIPTION OF EMBODIMENTS

Figure 1:
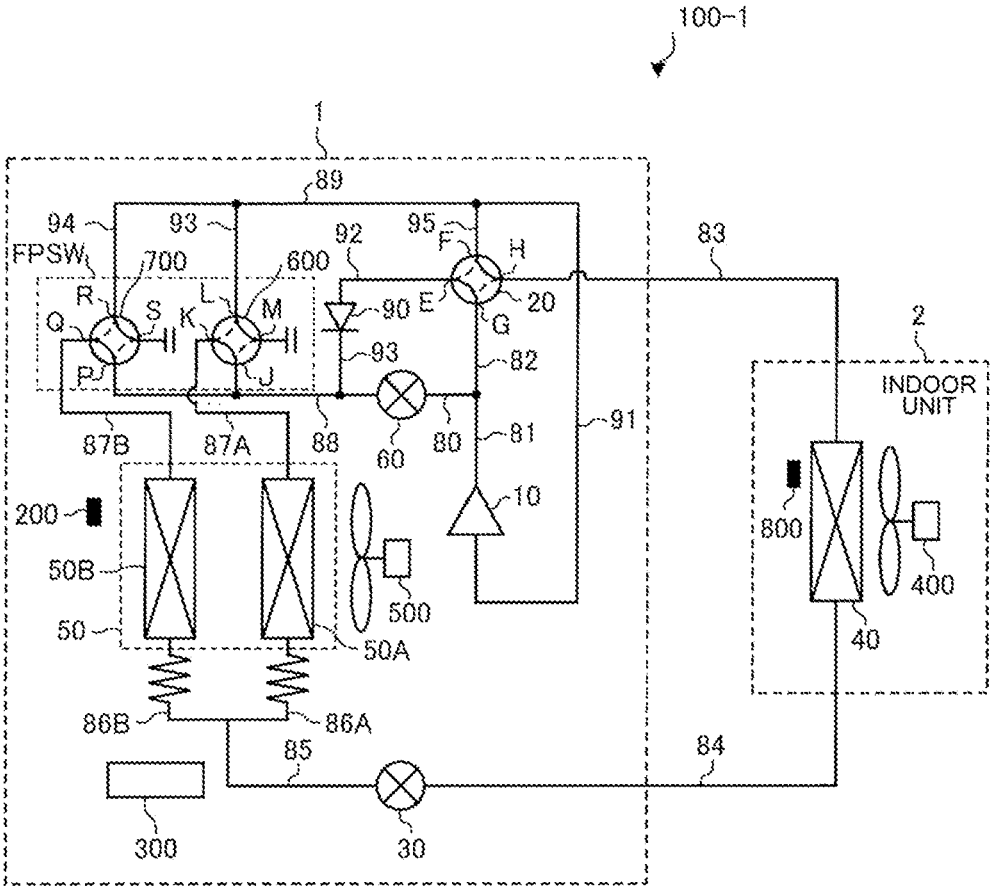
FIG. 1 is a refrigerant circuit diagram of an air-conditioning apparatus according to Embodiment 1.

Now, referring to the drawings, air-conditioning apparatuses according to embodiments will be described. Note that, descriptions of components will be given while the same components are denoted by the same reference signs in the drawings, and duplicated descriptions will be omitted unless necessary. In addition, the relationship of sizes of the components in the drawings may differ from that of actual ones.

Embodiment 1

FIG. 1 is a refrigerant circuit diagram of an air-conditioning apparatus 100-1 according to Embodiment 1.

The air-conditioning apparatus 100-1 according to Embodiment 1 has a configuration in which an outdoor unit 1 and an indoor unit 2 are provided separately and the outdoor unit 1 and the indoor unit 2 are connected to each other by refrigerant pipes 83, 84 and electric wiring (not shown).

[Outdoor Unit]

The outdoor unit 1 includes a compressor 10, a flow switching device 20, a first expansion device 30, a second expansion device 60, a flow passage selection device FPSW, an outdoor heat exchanger 50, an outdoor fan 500, an outdoor temperature detection device 200 configured to detect an outdoor temperature, and a controller 300. The flow passage selection device FPSW includes three-way valves 600 and 700. Note that, in this case, four-way valves are used as the three-way valves 600 and 700.

[Indoor Unit]

The indoor unit 2 includes an indoor heat exchanger 40, an indoor fan 400, and an indoor heat exchanger pipe temperature detection device 800.

The air-conditioning apparatus 100-1 has a refrigerant circuit in which the compressor 10, the flow switching device 20, the indoor heat exchanger 40, the first expansion device 30, the outdoor heat exchanger 50, and the three-way valves 600, 700 are sequentially connected by refrigerant pipes 81 to 85, 86A to 87A and/or 86B to 878, 89, and 91, and through which refrigerant circulates. Refrigerant to be circulated in this refrigerant circuit may be of various types, such as R32 and R410A.

A discharge side of the compressor 10 is connected to a J-port of the three-way valve 600 and a P-port of the three-way valve 700 by bypass pipes 80 and 88. The second expansion device 60 is installed between the bypass pipe 80 and the bypass pipe 88.

[Refrigerant Pipes and Bypass Pipes]

The refrigerant pipe 81 is connected to the discharge side of the compressor 10 and is divided into the bypass pipe 80 and the refrigerant pipe 82 on the way.

The refrigerant pipe 82 is connected to a G-port of the flow switching device 20.

The bypass pipe 80 is connected to the second expansion device 60.

The refrigerant pipe 83 connects an H-port of the flow switching device 20 and the indoor heat exchanger 40.

The refrigerant pipe 84 connects the indoor heat exchanger 40 and the first expansion device 30.

The refrigerant pipe 85 is connected to the first expansion device 30 and is divided into the refrigerant pipe 86A and the refrigerant pipe 86B on the way.

The outdoor heat exchanger 50 is divided into an upper-side outdoor heat exchanger 50A and a lower-side outdoor heat exchanger 50B, and their flow passages are independent of each other. The refrigerant pipe 86A is connected to the upper-side outdoor heat exchanger 50A of the outdoor heat exchanger 50, and the refrigerant pipe 86B is connected to the lower-side outdoor heat exchanger 50B of the outdoor heat exchanger 50. A capillary tube is installed in each of the refrigerant pipes 86A and 86B as an expansion device, but an expansion valve may be used instead.

The refrigerant pipe 87A connects the upper-side outdoor heat exchanger 50A and a K-port of the three-way valve 600, and the refrigerant pipe 87B connects the lower-side outdoor heat exchanger 50B and a Q-port of the three-way valve 700.

The bypass pipe 88 connects the J-port of the three-way valve 600 and the P-port of the three-way valve 700.

A refrigerant pipe 93 is connected to an L-port of the three-way valve 600, and a refrigerant pipe 94 is connected to an R-port of the three-way valve 700. The refrigerant pipe 93 and the refrigerant pipe 94 are joined together and connected to the refrigerant pipe 89.

A refrigerant pipe 95 connects the refrigerant pipe 89 and an F-port of the flow switching device 20.

A refrigerant pipe 91 connects the refrigerant pipe 89 and a suction side of the compressor 10.

[Controller 300]

The controller 300 is, for example, dedicated hardware or a central processing unit (CPU, also called central processor, processing device, arithmetic unit, microprocessor, microcomputer, or processor) configured to execute a program stored in a memory.

When the controller 300 is the dedicated hardware, the controller 300 corresponds to, for example, a single circuit, a composite circuit, an application specific integrated circuit (ASIC), a field programmable gate array (FPGA), or a combination of those circuits. The functional units implemented by the controller 300 may be achieved by respective pieces of hardware, or may be achieved by a single piece of hardware.

When the controller 300 is the CPU, each function executed by the controller 300 is achieved by software, firmware, or a combination of software and firmware. The software or the firmware is described as a program and is stored in a memory. The CPU is configured to read out and execute the program stored in the memory, to thereby achieve each of the functions of the controller 300. The memory is, for example, a RAM, a ROM, a flash memory, an EPROM, an EEPROM, or other types of non-volatile or volatile semiconductor memory.

Note that, some of the functions of the controller 300 may be achieved by the dedicated hardware and other functions thereof may be achieved by the software or the firmware.

The controller 300 is configured to control the components of the refrigerant circuit, such as the compressor 10, the flow switching device 20, the first expansion device 30, and the three-way valves 600 and 700.

The air-conditioning apparatus 100-1 according to the present embodiment has two types of operation modes, a cooling operation mode and a heating operation mode. In a heating operation, both of the upper-side outdoor heat exchanger 50A and the lower-side outdoor heat exchanger 50B function as evaporators. In a heating defrost operation, one of the upper-side outdoor heat exchanger 50A and the lower-side outdoor heat exchanger 50B functions as an evaporator and the other thereof functions as a condenser. The controller 300 performs one of the operation modes according to a selection made by a user.

An operation frequency of the compressor 10 is changed by the controller 300. By changing the operation frequency of the compressor 10, the amount and the pressure of the refrigerant to be discharged from the compressor 10 can be adjusted. Various types of compressors, such as a rotary type compressor, a reciprocating type compressor, a scroll type compressor, a screw type compressor, can be used as the compressor 10.

The flow switching device 20 is configured to switch between the cooling operation and the heating operation (including the heating defrost operation), and is a four-way valve, for example. The flow switching device 20 may be a combination of valves such as a two-way valve and a three-way valve. In the heating operation, the flow switching device 20 connects the refrigerant pipe 82, which is a discharge pipe of the compressor 10, and the refrigerant pipe 83 and connects the refrigerant pipe 95 and a refrigerant pipe 92, as shown by broken lines in the three-way valve in FIG. 1. In the cooling operation, the flow switching device 20 connects the refrigerant pipe 82 and the refrigerant pipe 92 and connects the refrigerant pipe 83 and the refrigerant pipe 95, as shown by solid lines in the three-way valve.

The first expansion device 30 is configured to decompress the refrigerant flowing therein, and is an expansion valve, for example.

The indoor fan 400 is provided beside the indoor heat exchanger 40 to supply air to the indoor heat exchanger 40.

The outdoor fan 500 is provided beside the outdoor heat exchanger 50 to supply air to the outdoor heat exchanger 50.

The outdoor heat exchanger 50 is a fin-tube heat exchanger having a plurality of heat-transfer pipes and a plurality of heat-transfer fins. The outdoor heat exchanger 50 is divided into an upper part, which is the upper-side outdoor heat exchanger 50A, and a lower part, which is the lower-side outdoor heat exchanger 50B. The upper-side outdoor heat exchanger 50A and the lower-side outdoor heat exchanger 50B are connected in parallel. Note that, flow directions of the refrigerant will be described when the operation modes are explained.

The bypass pipes 80 and 88 are installed to supply part of refrigerant discharged from the compressor 10 to the upper-side outdoor heat exchanger 50A and the lower-side outdoor heat exchanger 50B for defrosting. As an expansion mechanism, the second expansion device 60, which is, for example an expansion valve, is connected to the bypass pipe 80. After part of refrigerant discharged from the compressor 10 is decompressed into an intermediate pressure, the bypass pipes 80 and 88 guide the refrigerant to an object to be defrosted, the upper-side outdoor heat exchanger 50A or the lower-side outdoor heat exchanger 50B, via the three-way valve 600 or the three-way valve 700.

The three-way valve 600 and the three-way valve 700 can each be formed by blocking one of the four pipes of a four-way valve. Note that an M-port of the three-way valve 600 and an S-port of the three-way valve 700 are sealed to prevent the refrigerant from flowing out from the ports. In addition, the three-way valves 600 and 700 may each be a combination of two-way valves.

A check valve 90 is an example of a device that is configured to allow the refrigerant to flow in only one direction. By connecting the check valve 90 as shown in FIG. 1, the refrigerant flows in a direction from the refrigerant pipe 92 to the refrigerant pipe 93, and the refrigerant does not flow in a direction from the refrigerant pipe 93 to the refrigerant pipe 92.

The refrigerant pipe 87A is connected to the K-port of the three-way valve 600 and the refrigerant pipe 93 is connected to the L-port thereof. The refrigerant pipe 87B is connected to the Q-port of the three-way valve 700 and the refrigerant pipe 94 is connected to the R-port thereof. The refrigerant pipe 93 and the refrigerant pipe 94 are joined together and connected to the refrigerant pipe 89 at the joining part.

The bypass pipe 88 is divided into two branches. One of the branches is connected to the J-port of the three-way valve 600 and the other is connected to the P-port of the three-way valve 700.

Next, the operation modes of the air-conditioning apparatus 100-1 according to the present embodiment will be described.

[Cooling Operation]

First, the cooling operation will be explained. In the cooling operation, the three-way valve 600 is operated so that the J-port and the K-port are connected and the L-port and the M-port are connected. Similarly, the three-way valve 700 is operated so that the P-port and the Q-port are connected and the R-port and the S-port are connected.

The refrigerant in a high-temperature, high-pressure gas state discharged from the compressor 10 flows through the refrigerant pipe 82 and into the refrigerant pipe 92 via the flow switching device 20, and then flows through the check valve 90 and the refrigerant pipe 93 and into the bypass pipe 88.

Then, the refrigerant is divided into two streams and each flows into the corresponding one of the J-port of the three-way valve 600 and the P-port of the three-way valve 700. The refrigerant in a gas state flowed into the J-port of the three-way valve 600 flows through the refrigerant pipe 87A and then into the upper-side outdoor heat exchanger 50A. The refrigerant exchanges heat with outdoor air in the upper-side outdoor heat exchanger 50A. The refrigerant is thus condensed and enters a high-pressure liquid state, and then flows into the refrigerant pipe 86A. The refrigerant in a gas state flowed into the P-port of the three-way valve 700 flows through the refrigerant pipe 87B and then into the lower-side outdoor heat exchanger 50B. The refrigerant exchanges heat with outdoor air in the lower-side outdoor heat exchanger 50B. The refrigerant is thus condensed and enters a high-pressure liquid state, and then flows into the refrigerant pipe 86B.

The refrigerant in a liquid state flowing in the refrigerant pipe 86A and the refrigerant in a liquid state flowing in the refrigerant pipe 86B join together at a joining part of the refrigerant pipe 86A, the refrigerant pipe 86B, and the refrigerant pipe 85, and flow into the refrigerant pipe 85. Then, the refrigerant is decompressed by the first expansion device 30 and thus enters a low-temperature, low-pressure, two-phase state. The refrigerant then flows into the refrigerant pipe 84.

The refrigerant in a liquid state flowing in the refrigerant pipe 84 flows into the indoor heat exchanger 40. In the indoor heat exchanger 40, the refrigerant exchanges heat with indoor air. The refrigerant is thereby evaporated and enters a low-temperature, low-pressure gas state. The refrigerant then flows into the refrigerant pipe 83. The refrigerant in a gas state flowing in the refrigerant pipe 83 flows into the compressor 10 again via the flow switching device 20, the refrigerant pipe 95, and the refrigerant pipe 91.

According to the air-conditioning apparatus 100-1 of Embodiment 1, even when the three-way valve 600 is in a heating-circuit-side position state for some reason during the cooling operation, the three-way valve 700 outputs the refrigerant, which has been discharged from the compressor 10 and input into the three-way valve 700 via the flow switching device 20 and the bypass pipe 88, to the lower-side outdoor heat exchanger 508. In addition, even when the three-way valve 700 is in a heating-circuit-side position state for some reason during the cooling operation, the three-way valve 600 outputs the refrigerant, which has been discharged from the compressor 10 and input into the three-way valve 600 via the flow switching device 20 and the bypass pipe 88, to the upper-side outdoor heat exchanger 50A. Therefore, according to the air-conditioning apparatus 100-1 of Embodiment 1, occurrence of a cooling closed circuit is prevented during the cooling operation.

[Heating Operation]

Next, the heating operation will be explained. In the heating operation, the three-way valve 600 is operated so that the K-port and the L-port are connected and the J-port and the M-port are connected. Similarly, the three-way valve 700 is operated so that the Q-port and the R-port are connected and the P-port and the S-port are connected. Although the second expansion device 60 is in an open state, the refrigerant in the bypass pipe 88 does not flow from the J-port to the L-port or K-port in the three-way valve 600 and does not flow from the P-port to the R-port or Q-port in the three-way valve 700.

The refrigerant in a high-temperature, high-pressure gas state discharged from the compressor 10 flows into the refrigerant pipe 83 via the refrigerant pipe 81, the refrigerant pipe 82, and the flow switching device 20. The refrigerant in a gas state flowed from the refrigerant pipe 83 into the indoor heat exchanger 40 exchanges heat with indoor air in the indoor heat exchanger 40. The refrigerant is thus condensed and enters a high-pressure liquid state, and then flows into the refrigerant pipe 84.

The refrigerant flowed from the indoor heat exchanger 40 passes through the refrigerant pipe 84 and is decompressed by the first expansion device 30. The refrigerant thus enters a low-temperature, low-pressure, two-phase state, and flows into the refrigerant pipe 85. The refrigerant in a two-phase state flowing in the refrigerant pipe 85 is divided into two streams and each flows into the corresponding one of the refrigerant pipe 86A and the refrigerant pipe 86B. The refrigerant in a two-phase state divided to flow in the refrigerant pipe 86A flows into the upper-side outdoor heat exchanger 50A. At the upper-side outdoor heat exchanger 50A, the refrigerant exchanges heat with outdoor air. The refrigerant is thereby evaporated and enters a low-temperature, low-pressure gas state. The refrigerant in a two-phase state divided to flow in the refrigerant pipe 86B flows into the lower-side outdoor heat exchanger 50B. At the lower-side outdoor heat exchanger 50B, the refrigerant exchanges heat with outdoor air. The refrigerant is thereby evaporated and enters a low-temperature, low-pressure gas state.

The refrigerant flowed out from the upper-side outdoor heat exchanger 50A flows through the refrigerant pipe 87A and the three-way valve 600 and into the refrigerant pipe 93. The refrigerant flowed out from the lower-side outdoor heat exchanger 50B flows through the refrigerant pipe 87B and the three-way valve 700 and into the refrigerant pipe 94. The refrigerant flowing in the refrigerant pipe 93 and the refrigerant flowing in the refrigerant pipe 94 join together at a joining part of the refrigerant pipe 93, the refrigerant pipe 94, and the refrigerant pipe 89. The refrigerant then flows through the refrigerant pipe 89 and the refrigerant pipe 91, and enters the compressor 10 again.

[Heating Defrost Operation]

Next, the heating defrost operation will be explained.

While the heating operation is performed, frost is formed on the outdoor heat exchanger 50. When the upper-side outdoor heat exchanger 50A, for example, needs to be defrosted, the three-way valve 600 is operated so that the J-port and the K-port are connected and the M-port and the L-port are connected. At this time, the three-way valve 700 is operated so that the Q-port and the R-port are connected and the P-port and the S-port are connected.

Part of the refrigerant in a high-temperature, high-pressure gas state discharged from the compressor 10 flows into the bypass pipe 80, and the remaining refrigerant in a gas state flows into the indoor heat exchanger 40 via the refrigerant pipe 82, the flow switching device 20, and the refrigerant pipe 83.

The refrigerant flowed into the bypass pipe 80 is decompressed by the second expansion device 60, and then flows into the upper-side outdoor heat exchanger 50A, which is an object to be defrosted, via the bypass pipe 88, the three-way valve 600, and the refrigerant pipe 87A. The refrigerant flowed into the upper-side outdoor heat exchanger 50A is condensed while exchanging heat with the frost. The upper-side outdoor heat exchanger 50A is thus defrosted.

At this time, by changing an opening degree of the second expansion device 60 by the controller 300, the amount of refrigerant flowing into the upper-side outdoor heat exchanger 50A, which is an object to be defrosted, is adjusted, and the amount of heat to be exchanged between the refrigerant and the frost can thus be adjusted.

When the opening degree of the second expansion device 60 is increased, the amount of the refrigerant output from the second expansion device 60 is increased and the amount of the refrigerant flowing through the upper-side outdoor heat exchanger 50A is thus increased. As a result, the amount of heat to be exchanged between the refrigerant and the frost is increased. At this time, the amount of the refrigerant flowing in the indoor heat exchanger 40 is relatively reduced, and the heating capacity is thus reduced.

Meanwhile, when the opening degree of the second expansion device 60 is reduced, the amount of the refrigerant output from the second expansion device 60 is reduced and the amount of the refrigerant flowing through the upper-side outdoor heat exchanger 50A is thus reduced. As a result, the amount of heat to be exchanged between the refrigerant and the frost is reduced. At this time, the amount of the refrigerant flowing in the indoor heat exchanger 40 is relatively increased, and the heating capacity is thus increased.

At this time, by controlling the opening degree of the second expansion device 60 in such a manner that the saturation temperature of the refrigerant flowing in the upper-side outdoor heat exchanger 50A functioning as a condenser becomes higher than 0 degrees C. (around 0 to 10 degrees C., for example), defrosting can be performed efficiently by using latent heat of condensation. The saturation temperature of the refrigerant can be adjusted also by adjusting the amount of expansion by changing the length and the diameter of the capillary tube of the refrigerant pipe 86A.

The refrigerant condensed at the upper-side outdoor heat exchanger 50A is decompressed while passing through the refrigerant pipe 86A, then merges, at a joining part of the refrigerant pipe 85, with the refrigerant that has been condensed by the indoor heat exchanger 40 and has been decompressed by the first expansion device 30, and flows into the refrigerant pipe 86B.

The refrigerant flowed into the refrigerant pipe 86B flows into the lower-side outdoor heat exchanger 50B and is evaporated. Then, the refrigerant flows through the refrigerant pipe 87B, the three-way valve 700, the refrigerant pipe 94, the refrigerant pipe 89, and the refrigerant pipe 91, and enters the compressor 10 again.

When the lower-side outdoor heat exchanger 50B needs to be defrosted, the three-way valve 700 is operated so that the P-port and the Q-port are connected and the S-port and the R-port are connected. At this time, the three-way valve 600 is operated so that the J-port and the M-port are connected and the K-port and the L-port are connected. Part of the refrigerant in a high-temperature, high-pressure gas state discharged from the compressor 10 flows into the bypass pipe 80, and the remaining refrigerant in a gas state flows into the indoor heat exchanger 40 via the refrigerant pipe 82, the flow switching device 20, and the refrigerant pipe 83.

The refrigerant flowed into the bypass pipe 80 is decompressed by the second expansion device 60, and then flows into the lower-side outdoor heat exchanger 50B, which is an object to be defrosted, via the bypass pipe 88, the three-way valve 700, and the refrigerant pipe 87B. The refrigerant flowed into the lower-side outdoor heat exchanger 50B is condensed while exchanging heat with the frost. The lower-side outdoor heat exchanger 50B is thus defrosted.

At this time, by changing an opening degree of the second expansion device 60 by the controller 300, the amount of refrigerant flowing into the lower-side outdoor heat exchanger 50B, which is an object to be defrosted, is adjusted, and the amount of heat to be exchanged between the refrigerant and the frost can thus be adjusted.

When the opening degree of the second expansion device 60 is increased, the amount of the refrigerant output from the second expansion device 60 is increased and the amount of the refrigerant flowing through the lower-side outdoor heat exchanger 50B is thus increased. As a result, the amount of heat to be exchanged between the refrigerant and the frost is increased. At this time, the amount of the refrigerant flowing in the indoor heat exchanger 40 is relatively reduced, and the heating capacity is thus reduced.

Meanwhile, when the opening degree of the second expansion device 60 is reduced, the amount of the refrigerant output from the second expansion device 60 is reduced and the amount of the refrigerant flowing through the lower-side outdoor heat exchanger 50B is thus reduced. As a result, the amount of heat to be exchanged between the refrigerant and the frost is reduced. At this time, the amount of the refrigerant flowing in the indoor heat exchanger 40 is relatively increased, and the heating capacity is thus increased.

At this time, by controlling the opening degree of the second expansion device 60 in such a manner that the saturation temperature of the refrigerant flowing in the lower-side outdoor heat exchanger 50B functioning as a condenser becomes higher than 0 degrees C. (around 0 to 10 degrees C., for example), defrosting can be performed efficiently by using latent heat of condensation. The saturation temperature of the refrigerant can be adjusted also by adjusting the amount of expansion by changing the length and the diameter of the capillary tube of the refrigerant pipe 86B.

The refrigerant condensed at the lower-side outdoor heat exchanger 50B is decompressed while passing through the refrigerant pipe 86B, then merges, at a joining part of the refrigerant pipe 85, with the refrigerant that has been condensed by the indoor heat exchanger 40 and has been decompressed by the first expansion device 30, and flows into the refrigerant pipe 86A.

The refrigerant flowed into the refrigerant pipe 86A flows into the upper-side outdoor heat exchanger 50A and is evaporated. Then, the refrigerant flows through the refrigerant pipe 87A, the three-way valve 600, the refrigerant pipe 93, the refrigerant pipe 89, and the refrigerant pipe 91, and enters the compressor 10 again.

Note that, regarding the order of defrosting the upper-side outdoor heat exchanger 50A and the lower-side outdoor heat exchanger 50B being connected to each other in parallel, defrosting of the lower-side outdoor heat exchanger 50B is performed first and then defrosting of the upper-side outdoor heat exchanger 50A is performed. Then, it is preferred that defrosting of the lower-side outdoor heat exchanger 50B be performed again. The reason for this will be explained below.

For example, a case where defrosting of the upper-side outdoor heat exchanger 50A is performed first and then defrosting of the lower-side outdoor heat exchanger 50B is performed is considered. During defrosting of the upper-side outdoor heat exchanger 50A, frost formed on a heat transfer fin of the upper-side outdoor heat exchanger 50A melts into water droplets, and the water droplets flow down on the surface of the heat transfer fin. Hereinafter, a water droplet or a water flow of melted frost is referred to as drain water. Part of drain water flowed down to the lower-side outdoor heat exchanger 50B from the upper-side outdoor heat exchanger 50A is frozen again on the lower-side outdoor heat exchanger 50B functioning as an evaporator.

Then, when the lower-side outdoor heat exchanger 50B is defrosted, it is necessary to defrost not only frost that is formed on a heat transfer fin of the lower-side outdoor heat exchanger 50B during the heating operation but also re-frozen part of the drain water flowed down from the upper-side outdoor heat exchanger 50A. Consequently, it takes time to complete defrosting. During this defrost operation, because the upper-side outdoor heat exchanger 50A functions as an evaporator, more frost can form on the upper-side outdoor heat exchanger 50A. As a consequence, when the upper-side outdoor heat exchanger 50A is defrosted next time, it takes more time to complete defrosting.

To overcome this problem, defrosting of the lower-side outdoor heat exchanger 50B is performed first to defrost the frost formed in the heating operation, and then defrosting of the upper-side outdoor heat exchanger 50A is performed to defrost the frost formed in the heating operation. Finally, defrosting of the lower-side outdoor heat exchanger 50B is performed again to defrost re-frozen part of the drain water flowed down from the upper-side outdoor heat exchanger 50A. As a result, a time required for defrosting can be shortened.

Next, problems of the heating defrost operation in the refrigerant circuit having the outdoor heat exchanger 50, which is divided into an upper part, which is the upper-side outdoor heat exchanger 50A, and a lower part, which is the lower-side outdoor heat exchanger 50B, will be described.

Table 1 shows connection states of the ports in the three-way valve 600 and the three-way valve 700 for each operation mode. For first heating defrost operation, a circuit for defrosting the upper-side outdoor heat exchanger 50A is indicated. For second heating defrost operation, a circuit for defrosting the lower-side outdoor heat exchanger 50B is indicated.

TABLE 1

| | Three-way valve 700 | Three-way valve 600 |
|---|---|---|
| Cooling | 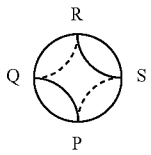  | 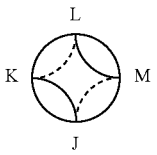  |
| Heating | 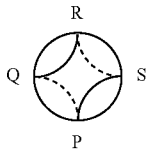  | 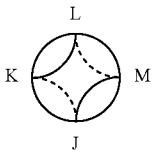  |

TABLE 1-continued

| | Three-way valve 700 | Three-way valve 600 |
|---|---|---|
| First heating defrost operation | 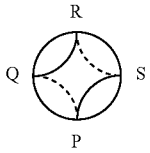  | 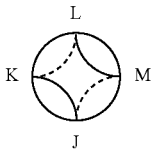  |
| Second heating defrost operation | 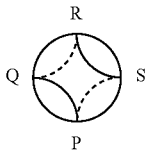  | 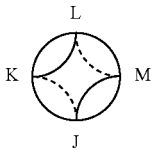  |

As the three-way valves 600 and 700 in the circuit of FIG. 1, a constant-energized-type three-way valve in which a coil needs to be energized to shift a main valve and a position of the main valve is maintained while the coil is being energized, or a latch-type three-way valve in which a coil needs to be energized only when a main valve is shifted can be selected. When the three-way valves 600 and 700 are constant-energized-type three-way valves, the positions of the main valves can be fixed in a de-energized state.

In a normal cooling operation, the three-way valve 600 is operated so that the J-port and the K-port are connected and the L-port and the M-port are connected. Similarly, the three-way valve 700 is operated so that the P-port and the Q-port are connected and the R-port and the S-port are connected.

Figure 2:
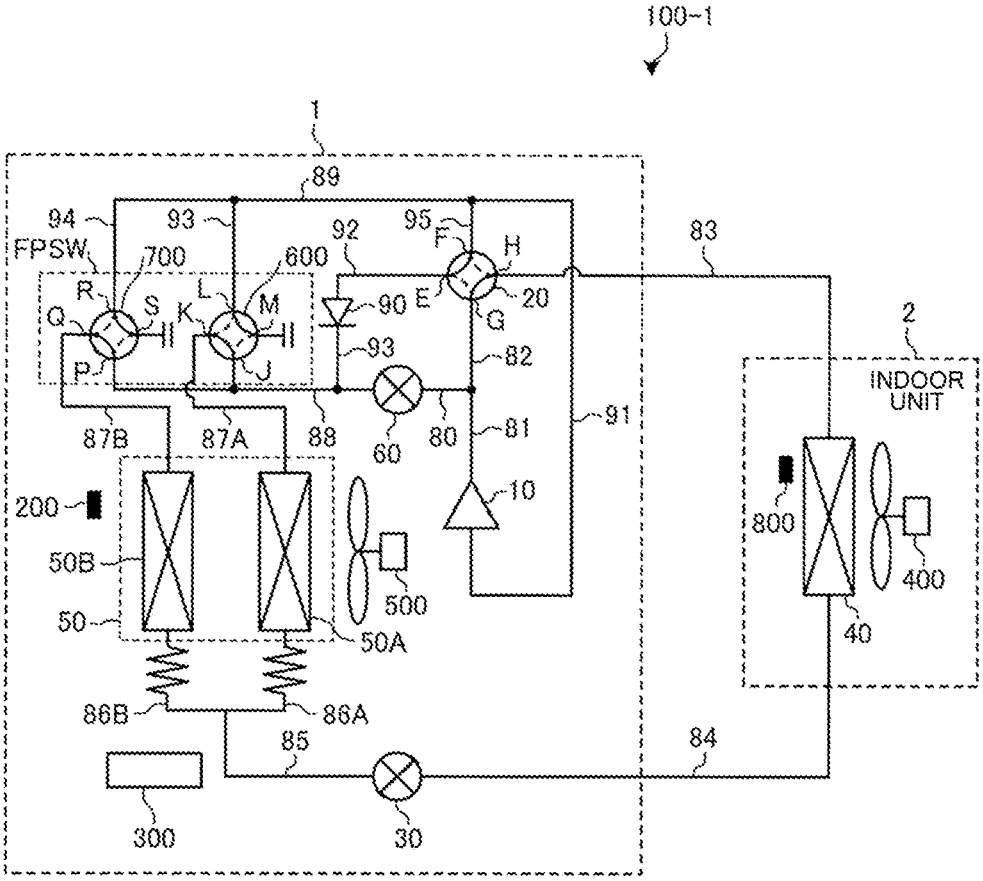
FIG. 2 is a view for illustrating a state in which three-way valves are in a cooling-circuit-side position state for some reason during a heating operation of the air-conditioning apparatus of Embodiment 1.

FIG. 2 is a view for illustrating a state in which the three-way valves 600 and 700 are in a cooling-circuit-side position state for some reason during a heating operation of the air-conditioning apparatus of Embodiment 1.

In a cooling-circuit-side position state, the J-port and the K-port are connected and the L-port and the M-port are connected in the three-way valve 600, and the P-port and the Q-port are connected and the R-port and the S-port are connected in the three-way valve 700.

When the heating operation is performed while the three-way valves 600 and 700 are in the cooling-circuit-side position state, refrigerant discharged from the compressor 10 flows through the indoor heat exchanger 40, the first expansion device 30 functioning as an expansion valve, and the outdoor heat exchanger 50, but cannot return to an inlet of the compressor 10. This results in a closed circuit operation, or a "heating closed circuit". When the operation is continued under this condition, comfortableness in the room cannot be attained because the temperature of the indoor heat exchanger 40 is not increased. In addition, the refrigerant discharge temperature and the temperature of winding of the compressor are raised. As a result, the compressor may be damaged.

Even when pipes on the discharge side of the compressor 10 form a closed circuit condition, the pipes have sufficient internal spaces. Therefore, a rise of refrigerant pressure is small and thus a possibility of refrigerant leakage due to pipe burst is small. In a normal heating operation, after the compressor 10 is activated, the refrigerant in a high-temperature, high-pressure compressed by the compressor 10 flows into the indoor unit 2, and thus the indoor heat exchanger pipe temperature detection device 800 configured to detect the temperature of the indoor heat exchanger detects a temperature rise.

However, in the heating closed circuit operation, the refrigerant compressed by the compressor does not enter a high-temperature, high-pressure state, and thus the indoor heat exchanger pipe temperature detection device 800 detects no temperature rise.

Figure 3:
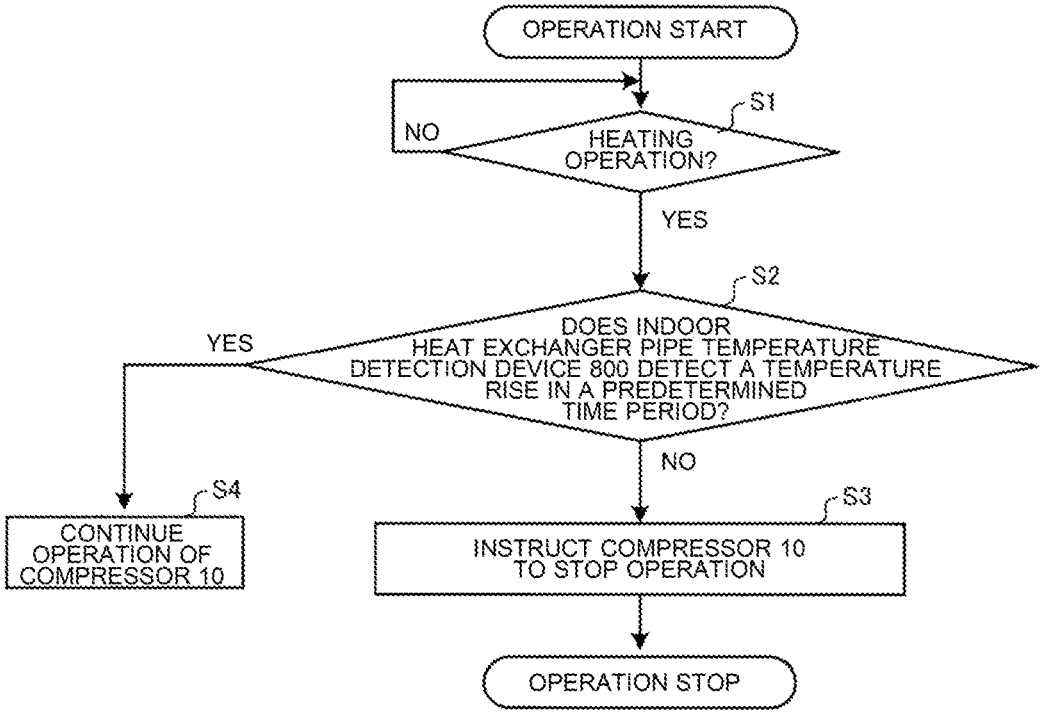
FIG. 3 is a flowchart illustrating an operation of a controller for preventing a heating closed circuit from occurring during a heating operation of the air-conditioning apparatus according to Embodiment 1.

FIG. 3 is a flowchart illustrating an operation of the controller 300 for preventing a heating closed circuit from occurring during the heating operation of the air-conditioning apparatus 100-1 according to Embodiment 1. As shown in FIG. 3, the controller 300 determines whether the air-conditioning apparatus 100-1 performs the heating operation (S1). In step S1, the controller 300 determines that the heating operation is not performed, the processing of step S1 is continued (NO in S1).

In step S1, when the controller 300 determines that the heating operation is performed (YES in S1), the controller 300 determines whether a temperature rise is detected by the indoor heat exchanger pipe temperature detection device 800 in a certain period of time. (S2).

In step 32, when the controller 300 determines that no temperature rise is detected by the indoor heat exchanger pipe temperature detection device 800 in a predetermined period of time after the heating operation is started (NO in S2), the controller 300 instructs the compressor 10 to stop the operation (S3), and the operation of the air-conditioning apparatus 100-1 is thus stopped. Meanwhile, in step S2, the controller 300 determines that a temperature rise is detected by the indoor heat exchanger pipe temperature detection device 800 in a predetermined period of time after the heating operation is started (YES in S2), the operation of the compressor is continued (S4).

According to Embodiment 1, when no temperature rise is detected by the indoor heat exchanger pipe temperature detection device 800 in a predetermined period of time after the heating operation is started, it is determined that a heating closed circuit occurs, and the operation is stopped. As a result, a failure of the compressor 10 can be avoided.

Embodiment 2

Figure 4:
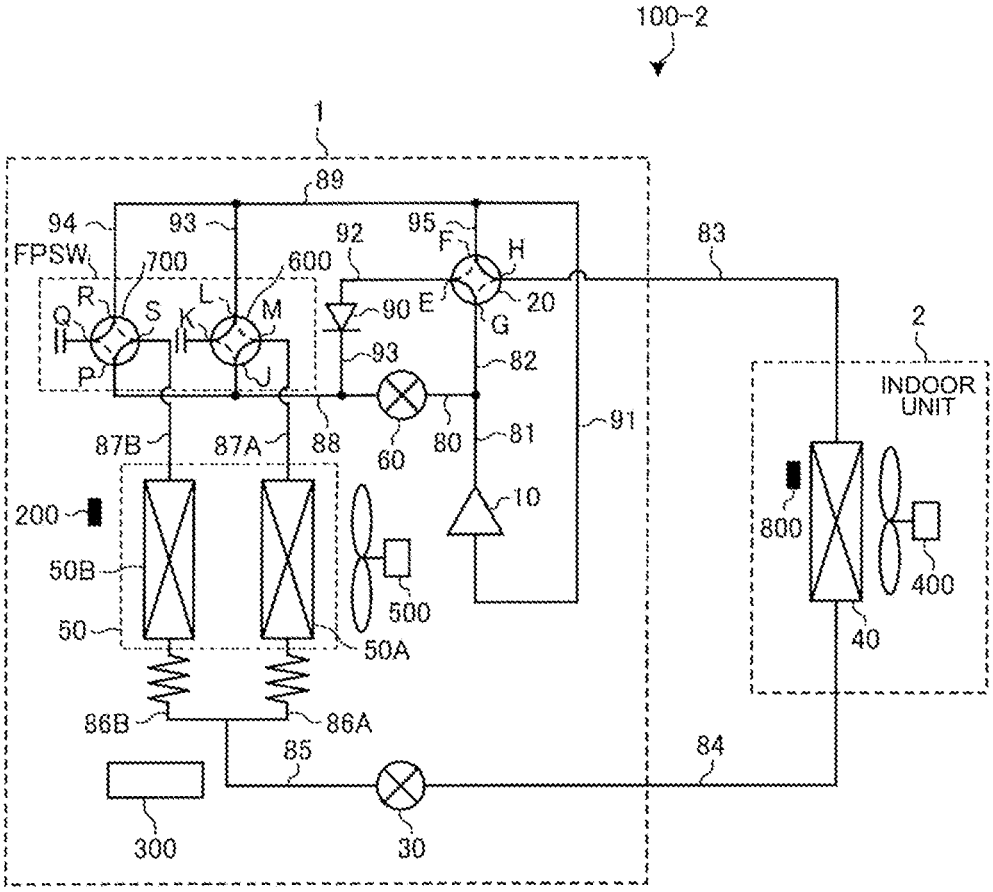
FIG. 4 is a refrigerant circuit diagram of an air-conditioning apparatus according to Embodiment 2.

Embodiment 2 is pertinent to an air-conditioning apparatus that prevents a cooling closed circuit, FIG. 4 is a refrigerant circuit diagram of an air-conditioning apparatus 100-2 according to Embodiment 2. Note that the same components as those of FIG. 1 will be denoted by the same reference signs, and components that differ from those of FIG. 1 will be explained blow.

In Embodiment 2, constant-energized-type three-way valves are used as the three-way valves 600 and 700 because the positions of the main valves can be recognized even when a coil is not energized due to failure of a substrate or the coil. With a latch-type three-way valve, the position of the main valve is not fixed at one position when a coil is not energized. Consequently, the position of the main valve can vary depending on the operation condition at which a failure occurs, and thus it is difficult to recognize flow passages of the refrigerant circuit. The controller 300 controls energization and de-energization of coils in the three-way valves 600 and 700.

Table 2 shows connection states of the ports in the three-way valve 600 and the three-way valve 700 for each operation mode and connection states of the ports in the three-way valve 600 and the three-way valve 700 for each energization state. For first heating defrost operation, a circuit for defrosting the upper-side outdoor heat exchanger 50A is indicated. For second heating defrost operation, a circuit for defrosting the lower-side outdoor heat exchanger 50B is indicated.

For ON side in Table 2, a state in which a coil of the corresponding three-way valve is energized is indicated. In this state, the J-port and the K-port are connected and the L-port and the M-port are connected in the three-way valve 600 of FIG. 4, and the P-port and the Q-port are connected and the R-port and the S-port are connected in the three-way valve 700.

Furthermore, for OFF side in Table 2, a state in which a coil of the corresponding three-way valve is not energized is indicated. In this state, the J-port and the M-port are connected and the K-port and the L-port are connected in the three-way valve 600 of FIG. 4, and the P-port and the S-port are connected and the R-port and the Q-port are connected in the three-way valve 700, as shown in Table 2.

TABLE 2

| | Three-way valve 700 | Three-way valve 600 |
|---|---|---|
| Cooling | R Q S P | L K M J |
| Heating | R Q S P | L K M J |
| First heating defrost operation | R Q S P | L K M J |
| Second heating defrost operation | R Q S P | L K M J |
| ON side | R Q S P | L K M J |
| OFF side | R Q S P | L K M J |

As shown in FIG. 4, the K-port of the three-way valve 600 and the Q-port of the three-way valve 700 are blocked so that no refrigerant flows out therefrom. Furthermore, the refrigerant circuit is configured so that both of the three-way valves 600 and 700 are de-energized to form a cooling circuit and energized to form a heating circuit. Here, such a switching type of the refrigerant circuit is referred to as a "heating energization type".

In other words, when the three-way valves 600 and 700 are in a de-energized state, a cooling circuit is formed in which the refrigerant compressed by the compressor 10 is caused to flow to the upper-side outdoor heat exchanger 50A and to the lower-side outdoor heat exchanger 50B. When the three-way valves 600 and 700 are in an energized state, a heating circuit is formed.

As shown in Table 2, when the air-conditioning apparatus 100-2 is operated in a cooling operation mode, the controller 300 does not energize the three-way valves 600 and 700. When the air-conditioning apparatus 100-2 is operated in a heating operation mode, the controller 300 energizes the three-way valves 600 and 700. Furthermore, when the air-conditioning apparatus 100-2 is operated in a first heating defrost operation mode, that is, when the upper-side outdoor heat exchanger 50A is defrosted, the controller 300 does not energize the three-way valve 600 and energizes the three-way valve 700. When the air-conditioning apparatus 100-2 is operated in a second heating defrost operation mode, that is, when the lower-side outdoor heat exchanger 50B is defrosted, the controller 300 energizes the three-way valve 600 and does not energize the three-way valve 700.

According to the air-conditioning apparatus 100-2 of Embodiment 2, it is possible to prevent occurrence of a closed circuit state when a failure that prevents energization of the three-way valves 600 and 700 occurs, and thus prevent occurrence of a cooling closed circuit causing refrigerant pipe burst and refrigerant leakage. Regarding a problem of a heating closed circuit, which may occur when a heating operation is used while a failure preventing energization of the three-way valves 600 and 700 occurs, the problem can be solved by using Embodiment 1.

Embodiment 3

Figure 5:
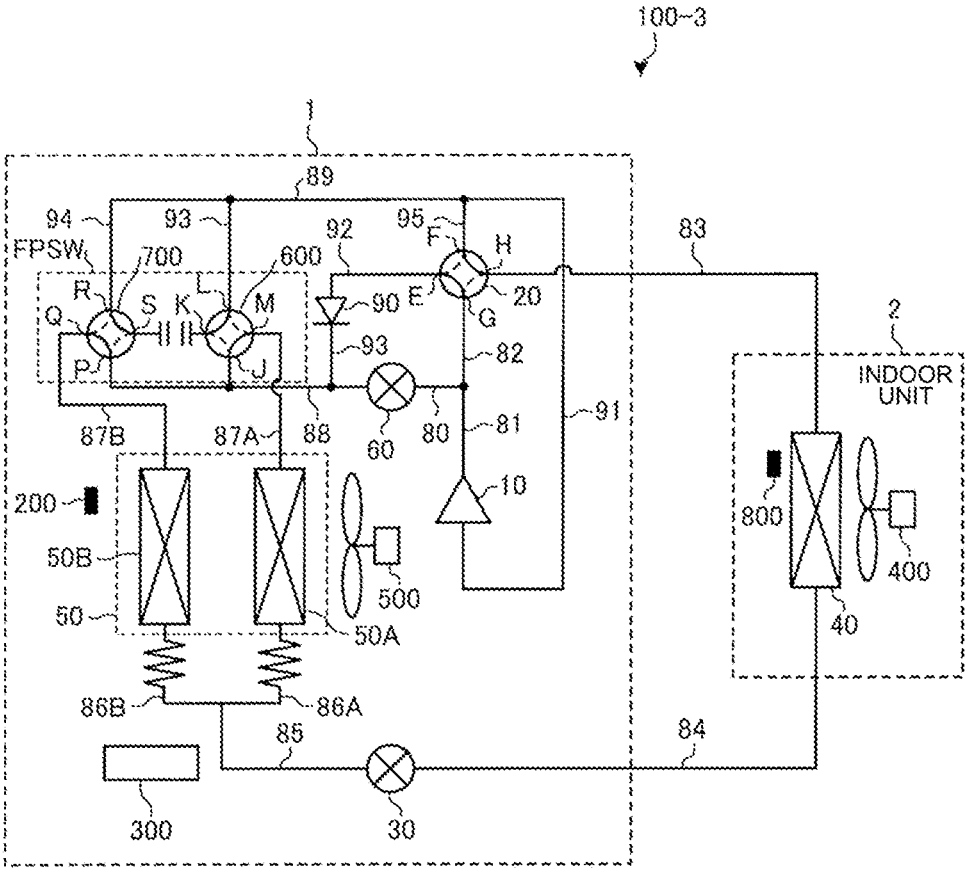
FIG. 5 is a refrigerant circuit diagram of an air-conditioning apparatus according to Embodiment 3.

FIG. 5 is a refrigerant circuit diagram of an air-conditioning apparatus 100-3 according to Embodiment 3. Note that the same components as those of FIG. 1 will be denoted by the same reference signs, and components that differ from those of FIG. 1 will be explained blow.

Table 3 shows connection states of the ports in the three-way valve 600 and the three-way valve 700 for each operation mode and connection states of the ports in the three-way valve 600 and the three-way valve 700 for each energization state. In Embodiment 3, constant-energized-type three-way valves are used as the three-way valves 600 and 700 of the flow passage selection device FPSW. The controller 300 controls energization and de-energization of coils in the three-way valves 600 and 700.

TABLE 3

| | Three-way valve 700 | Three-way valve 600 |
|---|---|---|
| Cooling | R, Q, S, P | L, K, M, J |

TABLE 3-continued

| | Three-way valve 700 | Three-way valve 600 |
|---|---|---|
| Heating | R, Q, S, P | L, K, M, J |
| First heating defrost operation | R, Q, S, P | L, K, M, J |
| Second heating defrost operation | R, Q, S, P | L, K, M, J |
| ON side | R, Q, S, P | L, K, M, J |
| OFF side | R, Q, S, P | L, K, M, J |

As shown in FIG. 5, the K-port of the three-way valve 600 and the S-port of the three-way valve 700 are blocked so that no refrigerant flows out therefrom. Furthermore, the refrigerant circuit is configured so that one of the three-way valves 600 and 700 is energized to form a cooling circuit and the other is energized to form a heating operation circuit. Such a switching type of the refrigerant circuit is referred to as a "cooling heating one-side energization type".

The cooling heating one-side energization type switching is achieved in such a manner that the three-way valve 600 in which one pipe among the four pipes is blocked and the three-way valve 700 in which one pipe at a different position among the four pipes is blocked are connected to the refrigerant circuit. In the cooling operation, the J-port and the M-port are connected and the K-port and the L-port are connected in the three-way valve 600. In the three-way valve 700, the P-port and the Q-port are connected and the S-port and the R-port are connected.

As shown in Table 3, when the air-conditioning apparatus 100-3 is operated in the cooling operation mode, the controller 300 does not energize the three-way valve 600 and does not energize the three-way valve 700. When the air-conditioning apparatus 100-3 is operated in the heating operation mode, the controller 300 energizes the three-way valve 600 and does not energize the three-way valve 700. Furthermore, when the air-conditioning apparatus 100-3 is operated in the first heating defrost operation mode, that is, when the upper-side outdoor heat exchanger 50A is defrosted, the controller 300 does not energize the three-way valves 600 and 700. When the air-conditioning apparatus 100-3 is operated in the second heating defrost operation mode, that is, when the lower-side outdoor heat exchanger 503 is defrosted, the controller 300 energizes the three-way valves 600 and 700.

According to the air-conditioning apparatus 100-3 of Embodiment 3, when a failure that prevents energization of the three-way valves 600 and 700 occurs during the cooling operation, refrigerant discharged from the compressor 10 flows through the J-port of the three-way valve 600 and the refrigerant pipe 87A and into the upper-side outdoor heat exchanger 50A. Although the refrigerant having been discharged from the compressor 10 and having reached the P-port of the three-way valve 700 reaches a dead end, the refrigerant circuit as a whole does not enter a closed circuit state. Therefore, occurrence of a cooling closed circuit causing refrigerant pipe burst and refrigerant leakage can be avoided.

Embodiment 4

Figure 6:
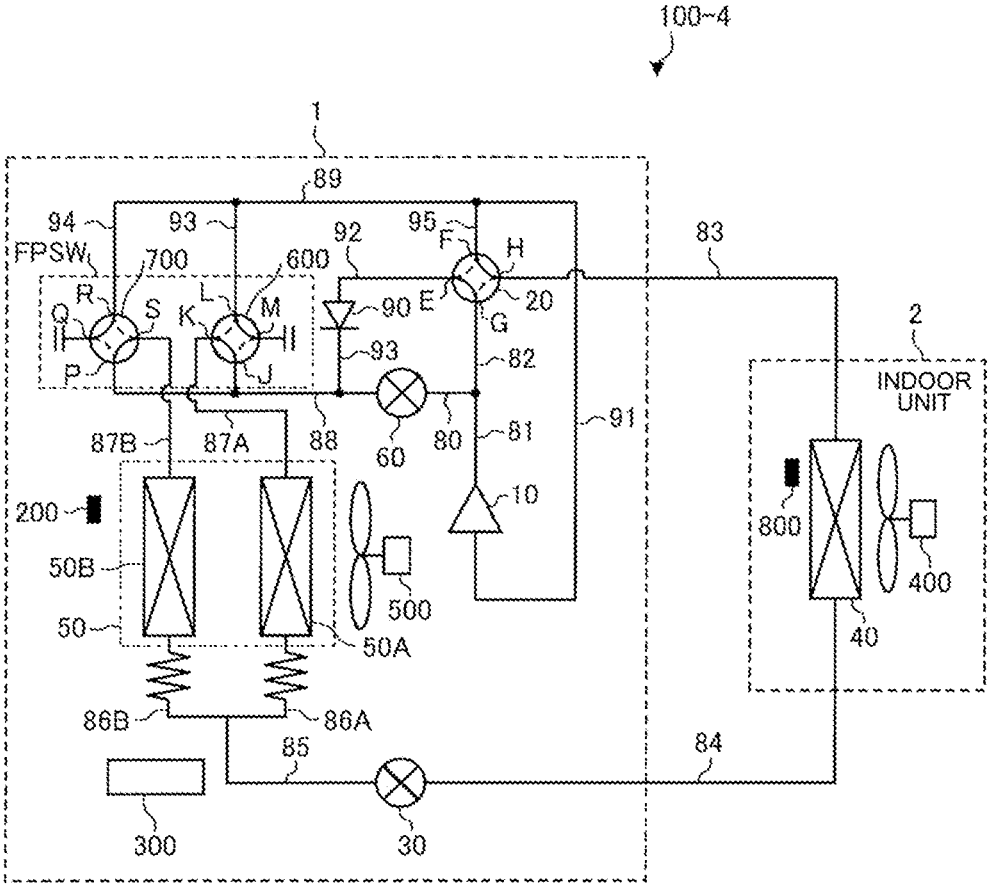
FIG. 6 is refrigerant circuit diagram of an air-conditioning apparatus according to Embodiment 4.

FIG. 6 is refrigerant circuit diagram of an air-conditioning apparatus 100-4 according to Embodiment 4. Note that the same components as those of FIG. 1 will be denoted by the same reference signs, and components that differ from those of FIG. 1 will be explained blow.

Table 4 shows connection states of the ports in the three-way valve 600 and the three-way valve 700 for each operation mode and connection states of the ports in the three-way valve 600 and the three-way valve 700 for each energization state.

In Embodiment 4, constant-energized-type three-way valves are used as the three-way valves 600 and 700 of the flow passage selection device FPSW. The controller 300 controls energization and de-energization of coils in the three-way valves 600 and 700.

TABLE 4

| | Three-way valve 700 | Three-way valve 600 |
|---|---|---|
| Cooling | 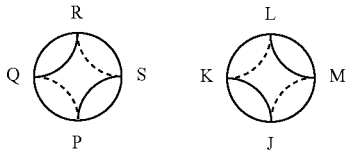  |   |
| Heating | 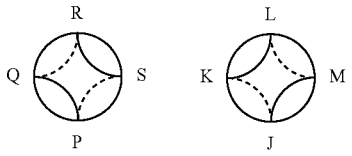  |   |
| First heating defrost operation | 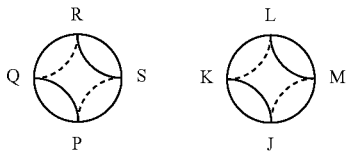  |   |
| Second heating defrost operation | 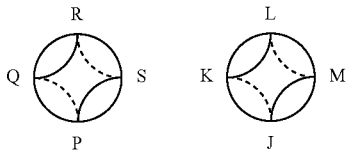  |   |

TABLE 4-continued

| | Three-way valve 700 | Three-way valve 600 |
|---|---|---|
| ON side | 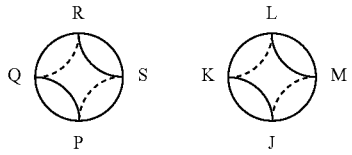  |   |
| OFF side | 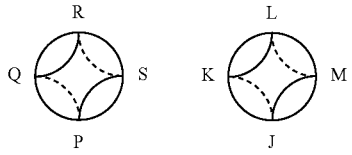  |   |

The M-port of the three-way valve 600 and the Q-port of the three-way valve 700 are blocked so that no refrigerant flows out therefrom. In this circuit, the refrigerant circuit is configured so that the lower-side outdoor heat exchanger 50B can be defrosted even when a failure preventing energization of the three-way valves 600 and 700 occurs during a heating defrost operation, in which the upper-side outdoor heat exchanger 50A and the lower-side outdoor heat exchanger 50B are alternately defrosted, or a reverse operation. Here, the reverse operation is an operation that melts frost on an outdoor heat exchanger by switching circuits from a heating operation circuit to a cooling operation circuit so that the outdoor heat exchanger functions as a condenser.

As shown in Table 4, when the air-conditioning apparatus 100-4 is operated in the cooling operation mode, the controller 300 energizes the three-way valve 600 and does not energize the three-way valve 700. When the air-conditioning apparatus 100-4 is operated in the heating operation mode, the controller 300 does not energize the three-way valve 600 and energizes the three-way valve 700. Furthermore, when the air-conditioning apparatus 100-4 is operated in the first heating defrost operation mode, that is, when the upper-side outdoor heat exchanger 50A is defrosted, the controller 300 energizes the three-way valves 600 and 700. When the air-conditioning apparatus 100-4 is operated in the second heating defrost operation mode, that is, when the lower-side outdoor heat exchanger 508 is defrosted, the controller 300 does not energize the three-way valves 600 and 700.

According to Embodiment 4, the three-way valve 700 connected to the lower-side outdoor heat exchanger 50B is configured so that a reverse operation/lower-side outdoor heat exchanger defrosting circuit is formed in a de-energized state. With this configuration, even when a failure preventing energization of the three-way valves 600 and 700 occurs, defrosting of the lower-side outdoor heat exchanger 50B is continued in the air-conditioning apparatus 100-4.

When the lower-side outdoor heat exchanger 50B cannot be defrosted, frost and ice are accumulated thereon. The accumulated frost and ice block a drain water discharge hole provided on a bottom sheet metal component, which is a base for fixing each component of the outdoor unit, such as the compressor 10 and the outdoor heat exchanger 50, and thus drain water cannot be discharged from the hole. In addition, frost and ice accumulated around the base applies an excessive stress onto a refrigerant pipe of the outdoor heat exchanger 50. As a result, the refrigerant pipe may be crushed and thereby flow of the refrigerant is blocked.

Consequently, a closed circuit may be generated and the heat exchange amount may be lowered. Furthermore, the accumulated frost and ice may break the refrigerant pipe and leakage of the refrigerant may thus occur.

According to the air-conditioning apparatus of Embodiment 4, even when a failure that prevents energization of the three-way valves 600 and 700 occurs, defrosting of the lower-side outdoor heat exchanger 50B is continued. It is therefore possible to prevent a situation in which accumulated frost and ice block the drain water discharge hole and drain water cannot be discharged from the hole. In addition, it is possible to prevent a situation in which ice accumulated around the base of the outdoor unit 1 crushes or breaks a refrigerant pipe, thereby causing leakage of the refrigerant.

Embodiment 5

Figure 7:
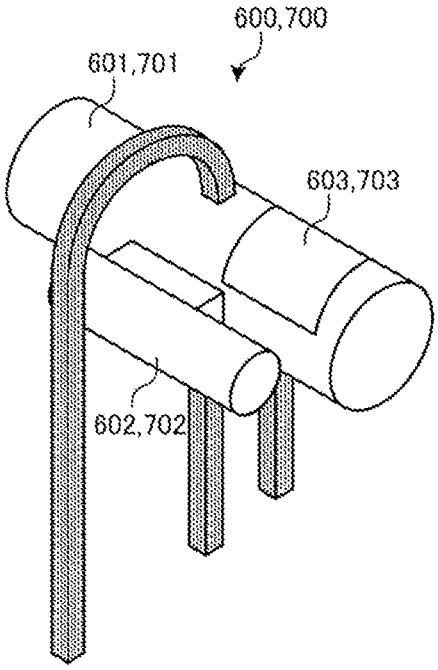
FIG. 7 is a diagram illustrating a three-way valve of an air-conditioning apparatus according to Embodiment 5.

FIG. 7 is a diagram illustrating the three-way valve 600, 700 of an air-conditioning apparatus according to Embodiment 5. As shown in FIG. 7, a three-way valve body 601 of the three-way valve 600 has a plunger 602. The three-way valve body 601 also has a type name sticker 603 attached on the surface. The type name sticker 603 indicates a model number, a serial number, a manufacturer name, and other information of the three-way valve 600. Similarly, a three-way valve body 701 of the three-way valve 700 has a plunger 702. The three-way valve body 701 also has a type name sticker 703 attached on the surface. The type name sticker 703 indicates a model number, a serial number, a manufacturer name, and other information of the three-way valve 700.

Figure 8:
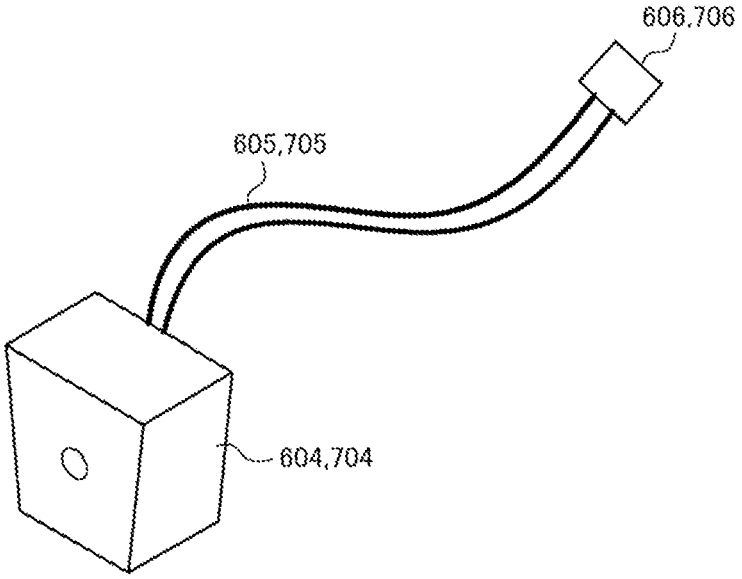
FIG. 8 is a diagram illustrating a three-way valve coil of the three-way valve of the air-conditioning apparatus according to Embodiment 5.

FIG. 8 is a diagram illustrating a coil 604, 704 for three-way valve of the three-way valve 600, 700 of the air-conditioning apparatus according to Embodiment 5. The coil 604 for three-way valve is provided on the plunger 602. The coil 604 for three-way valve is connected to a three-way valve side coil connector 606 via a coil lead wire 605. Similarly, the coil 704 for three-way valve is provided on the plunger 702. The coil 704 for three-way valve is connected to a three-way valve side coil connector 706 via a coil lead wire 705.

Figure 9:
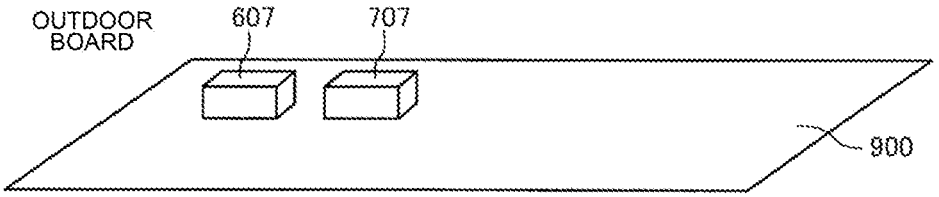
FIG. 9 is a diagram illustrating an outdoor board provided in an outdoor unit of the air-conditioning apparatus according to Embodiment 5.

FIG. 9 is a diagram illustrating an outdoor board 900 provided in an outdoor unit of the air-conditioning apparatus according to Embodiment 5. As shown in FIG. 9, the outdoor board 900 provided in the outdoor unit includes a board side connector 607 that receives the three-way valve side coil connector 606 and a board side connector 707 that receives the three-way valve side coil connector 706.

The three-way valve side coil connector 606 is connected to the board side connector 607. The three-way valve side coil connector 706 is connected to the board side connector 707. A part or an entire area of each of the type name sticker 603, the coil lead wire 605, the three-way valve side coil connector 606, and the board side connector 607 of the three-way valve 600 is colored so that a user can visually recognize that all of these components belong to the same system. For example, a part or an entire area of each of the type name sticker 603, the coil lead wire 605, the three-way valve side coil connector 606, and the board side connector 607 of the three-way valve 600 is colored in a same red color.

Similarly, a part or an entire area of each of the type name sticker 703, the coil lead wire 705, the three-way valve side coil connector 706, and the board side connector 707 of the three-way valve 700 is colored so that the user can visually recognize that all of these components belong to the same system. For example, a part or an entire area of each of the type name sticker 703, the coil lead wire 705, the three-way valve side coil connector 706, and the board side connector 707 of the three-way valve 700 is colored in a same blue color.

With such a configuration, in FIG. 4 of Embodiment 2, when the three-way valve 600 is connected to the board side connector 607 of the outdoor board 900, an incorrect connection of the three-way valve 600 to the board side connector 707 of the outdoor board 900 can be prevented. Similarly, when the three-way valve 700 is connected to the board side connector 707 of the outdoor board 900, an incorrect connection of the three-way valve 700 to the board side connector 607 of the outdoor board 900 can be prevented.

Therefore, according to the air-conditioning apparatus of Embodiment 5, it is possible to prevent a situation in which the heating defrost operation is performed in the order of the upper-side outdoor heat exchanger 50A, the lower-side outdoor heat exchanger 50B, and the upper-side outdoor heat exchanger 50A due to an incorrect connection, instead of the correct order of the lower-side outdoor heat exchanger 50B, the upper-side outdoor heat exchanger 50A, and the lower-side outdoor heat exchanger 50B, and it thus takes a longer time to complete the defrosting.

Furthermore, in FIG. 5 of Embodiment 3 and FIG. 6 of Embodiment 4, when the coil 604 for three-way valve and the coil 704 for three-way valve are installed, an incorrect connection of the three-way valve 600 to the board side connector 707 and an incorrect connection of the three-way valve 700 to the board side connector 607 can be prevented.

According to the air-conditioning apparatus of Embodiment 5, when the cooling circuit is used in which the E-port and the G-port communicate with each other and the F-port and H-port communicate with each other in the flow switching device 20, occurrence of a cooling closed circuit causing refrigerant pipe burst and refrigerant leakage can be avoided.

As described above, the air-conditioning apparatus 100-1 according to Embodiment 1 includes the refrigerant circuit in which the compressor 10 configured to compress and discharge the refrigerant, the indoor heat exchanger 40 configured to exchange heat between refrigerant discharged from the compressor 10 and indoor air, the first expansion device 30, configured to decompress the refrigerant having been condensed in the indoor heat exchanger 40, the outdoor heat exchanger 50 including the upper-side outdoor heat exchanger 50A and the lower-side outdoor heat exchanger 50B each having an independent flow passage, the outdoor heat exchanger 50 being configured to exchange heat between the refrigerant having passed through the first expansion device 30 and outdoor air, and the three-way valves 600 and 700 configured to be selectively switched to a flow passage on the upper-side outdoor heat exchanger 50A side and to a flow passage on the lower-side outdoor heat exchanger 50B side, respectively, are successively connected by pipes and through which the refrigerant circulates. The air-conditioning apparatus 100-1 also includes the outdoor fan 500 configured to supply air to the outdoor heat exchanger 50, the bypass pipes 80 and 88 connecting the discharge side of the compressor 10 and the three-way valves 600 and 700, the second expansion device 60 provided between the bypass pipes 80 and 88, and the controller 300 configured to perform the heating defrost operation, in which the upper-side outdoor heat exchanger 50A and the lower-side outdoor heat exchanger 50B are alternately defrosted during the heating operation.

According to the air-conditioning apparatus 100-2 of Embodiment 2, a constant-energized-type three-way valves is used as the flow passage selection device, and the refrigerant circuit is configured so that the three-way valve is de-energized to form a cooling circuit and energized to form a heating operation circuit. With such a configuration, occurrence of a cooling closed circuit causing refrigerant pipe burst and refrigerant leakage can be avoided even when a failure preventing energization of the three-way valves occurs.

According to the air-conditioning apparatus 100-3 of Embodiment 3, two constant-energized-type three-way valves are used, and the refrigerant circuit is configured so that one of the three-way valves is energized to form a cooling circuit and the other is energized to form a heating operation circuit. This refrigerant circuit is achieved in such a manner that one of the two three-way valves in which one pipe among the four pipes is blocked and the other three-way valve in which one pipe at a different position among the four pipes is blocked are connected to the refrigerant circuit. With such a configuration, occurrence of a cooling closed circuit causing refrigerant pipe burst and refrigerant leakage can be avoided even when a failure preventing energization of the three-way valve occurs.

According to the air-conditioning apparatus 100-4 of Embodiment 4, the refrigerant circuit is configured so that the lower-side outdoor heat exchanger 50B can be defrosted during the heating defrost operation, in which the upper-side heat exchanger and the lower-side heat exchanger are alternately defrosted, or during the reverse operation even when a failure preventing energization of the three-way valves 600 and 700 occurs. That is, by configuring the three-way valve connected to the lower-side outdoor heat exchanger 50B so that a reverse operation/lower-side outdoor heat exchanger defrosting circuit is formed in a de-energized state, defrosting of the lower-side outdoor heat exchanger 50B is continued even when a failure preventing energization of the three-way valves occurs. Therefore, even when a failure preventing energization of the three-way valves occurs, it is possible to prevent a situation in which ice accumulated around the base of the outdoor unit 1 crushes or breaks a refrigerant pipe, thereby causing leakage of the refrigerant.

Note that, during the heating defrost operation, the opening degree of the second expansion device 60, the operation frequency of the compressor 10, and the opening degree of the first expansion device 30 can be changed as necessary. For example, to increase the amount of heat exchange in the indoor heat exchanger 40 during the heating defrost operation, the operation frequency of the compressor 10 may be increased. In addition, to increase the amount of heat exchange in the indoor heat exchanger 40, the opening degree of the second expansion device 60 may be changed in a closing direction. In this case, the amount of the refrigerant flowing in the bypass pipe 88 is reduced, and the amount of heat exchange in the heat exchanger, which is an object to be defrosted, is thus reduced. Furthermore, to lower the temperature of the refrigerant to be discharged from the compressor 10, the opening degree of the first expansion device 30 may be changed in an opening direction.

According to the air-conditioning apparatus of any one of the embodiments, constant-energized-type three-way valves, each in which a coil needs to be energized to shift a main valve and a position of the main valve is maintained while the coil is being energized, are used as the flow passage selection device FPSW. Such a constant-energized-type three-way valve is preferable because the position of the main valve can be recognized even when the coil is not energized due to failure of a substrate or the coil. This three-way valve can be formed by blocking one of the four pipes of a four-way valve.

The refrigerant circuit is configured so that one of the two three-way valves is energized to form the cooling circuit and the other is energized to form the heating operation circuit. This refrigerant circuit is achieved in such a manner that one of the two three-way valves in which one pipe among the four pipes is blocked and the other three-way valve in which one pipe at a different position among the four pipes is blocked are connected to the refrigerant circuit.

With this configuration, even when a failure preventing energization of the three-way valves occurs during the cooling operation, refrigerant discharged from the compressor flows through one of the two three-way valves and into the outdoor heat exchanger and thus the refrigerant circuit as a whole does not enter a closed circuit state. In addition, occurrence of a cooling closed circuit causing refrigerant pipe burst and refrigerant leakage can be avoided.

In the above embodiments, the three-way valve 600 is also referred to as the first flow passage selection device, the three-way valve 700 is also referred to as the second flow passage selection device, and the first expansion device 30 is also referred to as the expansion device. The three-way valve body 601, the plunger 602, the type name sticker 603, the coil 604 for three-way valve, the coil lead wire 605, and the three-way valve side coil connector 606 of the three-way valve 600 are also referred to respectively as a first three-way valve body, a first plunger, a first type name sticker, a first three-way valve coil, a first coil lead wire, and a first three-way valve side coil connector. The three-way valve body 701, the plunger 702, the type name sticker 703, the coil 704 for three-way valve, the coil lead wire 705, and the three-way valve side coil connector 706 of the three-way valve 700 are also referred to respectively as a second three-way valve body, a second plunger, a second type name sticker, a second three-way valve coil, a second coil lead wire, and a second three-way valve side coil connector. The board side connector 607 for the three-way valve 600 of the outdoor board 900 is also referred to as a first board side connector, and the board side connector 707 for the three-way valve 700 of the outdoor board 900 is also referred to as a second board side connector.

The embodiments are provided as examples and are not intended to limit the scope of the embodiments. The embodiments can be implemented in other various modes, and various omissions, replacements, and modifications can be made without departing from the gist of the embodiments. These embodiments and modifications thereof are included in the scope and gist of the embodiments.

REFERENCE SIGNS LIST

1: outdoor unit, 2: indoor unit, 10: compressor, 20: flow switching device, 30: first expansion device, 40: indoor heat exchanger, 50: outdoor heat exchanger, 50A: upper-side outdoor heat exchanger, 503: lower-side outdoor heat exchanger, 60: second expansion device, 80: bypass pipe, 81 to 85: refrigerant pipe, 86A: refrigerant pipe, 86B: refrigerant pipe, 87A: refrigerant pipe, 87B: refrigerant pipe, 88: bypass pipe, 89: refrigerant pipe, 90: check valve, 91 to 95: refrigerant pipe, 100: air-conditioning apparatus, 200: outdoor temperature detection device, 300: controller, 400: indoor fan, 500: outdoor fan, 600: three-way valve. 601: three-way valve body, 602: plunger, 603: type name sticker, 604: three-way valve coil, 605: coil lead wire, 606: three-way valve side coil connector, 607: board side connector, 700: three-way valve, 701: three-way valve body, 702: plunger, 703: type name sticker, 704: three-way valve coil, 705: coil lead wire, 706: three-way valve side coil connector, 707: board side connector, 800: indoor heat exchanger pipe temperature detection device, 900: outdoor unit board, FPSW: flow passage selection device

The invention claimed is:

1. An air-conditioning apparatus comprising:

a refrigerant circuit through which refrigerant circulates and in which a compressor configured to compress and discharge refrigerant, a flow switching device connected to a refrigerant pipe of the compressor, the flow switching device being at least one valve, an indoor heat exchanger connected by a pipe via the flow switching device and configured to exchange heat between refrigerant and indoor air, an expansion device configured to decompress refrigerant, the expansion device being at expansion valve or a capillary tube, an outdoor heat exchanger including an upper-side outdoor heat exchanger and a lower-side outdoor heat exchanger each having an independent flow passage, the outdoor heat exchanger being configured to exchange heat between refrigerant having passed through the expansion device and outdoor air, a first flow passage selection device connected to a pipe of the upper-side outdoor heat exchanger of the outdoor heat exchanger and a pipe on a suction side of the compressor, a second flow passage selection device connected to a pipe of the lower-side outdoor heat exchanger of the outdoor heat exchanger and a pipe on the suction side of the compressor, and a bypass pipe connecting between a discharge side of the compressor and the first flow passage selection device and connecting between the discharge side of the compressor and the second flow passage selection device are provided; and a controller configured to control the flow switching device configured to switch the refrigerant circuit between a cooling circuit in which the first flow passage selection device and the second flow passage selection device cause refrigerant discharged from the compressor and input therein via the bypass pipe to flow into the upper-side outdoor heat exchanger and the lower-side outdoor heat exchanger, respectively, and a heating circuit in which the first flow passage selection device and the second flow passage selection device cause refrigerant input therein from the upper-side outdoor heat exchanger and the lower-side outdoor heat exchanger to flow into the pipes on the suction side of the compressor, the first flow passage selection device and the second flow passage selection device each being a constant-energized-type three-way valve in which a position of a main valve can be fixed in a de-energized state, wherein in a case where the refrigerant circuit is switched to the cooling circuit by the flow switching device, in a first situation that only one of the first flow passage selection device and the second flow passage selection device is in a de-energized state, and in a second situation that both of the first flow passage selection device and the second flow passage selection device are in a de-energized state, the first flow passage selection device or the second flow passage selection device in the de-energized state is configured to output refrigerant discharged from the compressor and input therein via the flow switching device and the bypass pipe to a corresponding one of the upper-side outdoor heat exchanger and the lower-side outdoor heat exchanger.

2. The air-conditioning apparatus of claim 1, wherein the controller is configured to, when the refrigerant circuit is switched to the cooling circuit by the flow switching device, control the first flow passage selection device and the second flow passage selection device so that the first flow passage selection device and the second flow passage selection device enter a de-energized state, the first flow passage selection device controlled to enter the de-energized state outputs refrigerant discharged from the compressor and input therein via the bypass pipe to the upper-side outdoor heat exchanger, and the second flow passage selection device controlled to enter the de-energized state outputs refrigerant discharged from the compressor and input therein via the bypass pipe to the lower-side outdoor heat exchanger.

3. The air-conditioning apparatus of claim 1, wherein the controller is configured to, when the refrigerant circuit is switched to the cooling circuit by the flow switching device, control the first flow passage selection device so that the first flow passage selection device enter a de-energized state, and the first flow passage selection device controlled to enter the de-energized state outputs refrigerant discharged from the compressor and input therein via the bypass pipe to the upper-side outdoor heat exchanger.

4. The air-conditioning apparatus of claim 1, further comprising an indoor heat exchanger pipe temperature detector configured to detect a temperature of the indoor heat exchanger, wherein the controller is configured to continue an operation of the compressor when a rise in temperature detected by the indoor heat exchanger pipe temperature detector is detected in a predetermined period of time after a heating operation of the air-conditioning apparatus is started.

5. The air-conditioning apparatus of claim 1, wherein the controller is configured to perform a heating defrost operation in which defrosting of the upper-side outdoor heat exchanger and defrosting of the lower-side outdoor heat exchanger are alternately performed in a state of the heating circuit, or a reverse operation in which defrosting is performed by switching the refrigerant circuit from the heating circuit to the cooling circuit, and control the second flow passage selection device so that the second flow passage selection device enters a de-energized state in the heating defrost operation in which defrosting of the lower-side outdoor heat exchanger is performed or the reverse operation, and the second flow passage selection device controlled to enter the de-energized state is configured to output refrigerant discharged from the compressor and input therein via the bypass pipe to the lower-side outdoor heat exchanger.

6. The air-conditioning apparatus of claim 1, further comprising:

an outdoor board of an outdoor unit, the outdoor board being provided with a first board side connector for the first flow passage selection device and a second board side connector for the second flow passage selection device, wherein the first flow passage selection device includes a first three-way valve body having a first plunger, a first three-way valve coil provided on the plunger of the first three-way valve body, a first coil lead wire connected to the first three-way valve coil, a first three-way valve side coil connector connected to the first coil lead wire, and a first type name sticker attached on the first three-way valve body, and the second flow passage selection device includes a second three-way valve body having a second plunger, a second three-way valve coil provided on the plunger of the second three-way valve body, a second coil lead wire connected to the second three-way valve coil, a second three-way valve side coil connector connected to the second coil lead wire, and a second type name sticker attached on the second three-way valve body, and wherein a part or an entire area of each of the first type name sticker, the first coil lead wire, the first three-way valve side coil connector, and the first board side connector is colored in a first color, and a part or an entire area of each of the second type name sticker, the second coil lead wire, the second three-way valve side coil connector, and the second board side connector is colored in a second color different from the first color.

* * * * *